US007086884B2

(12) United States Patent
Okano

(10) Patent No.: US 7,086,884 B2
(45) Date of Patent: Aug. 8, 2006

(54) ELECTRICAL CONNECTOR FOR FLEXIBLE FLAT CABLE

(75) Inventor: Kazuya Okano, Kanagawa (JP)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/535,786

(22) PCT Filed: Nov. 25, 2003

(86) PCT No.: PCT/JP03/14988

§ 371 (c)(1),
(2), (4) Date: Nov. 21, 2005

(87) PCT Pub. No.: WO2004/049514

PCT Pub. Date: Jun. 10, 2004

(65) Prior Publication Data

US 2006/0141837 A1 Jun. 29, 2006

(30) Foreign Application Priority Data

Nov. 26, 2002 (JP) ..... 2002-342832

(51) Int. Cl.
*H01R 13/15* (2006.01)

(52) U.S. Cl. ..... 439/260; 439/495

(58) Field of Classification Search ..... 439/260, 439/495, 267

See application file for complete search history.

(56) References Cited

U.S. PATENT DOCUMENTS

| | | | | |
|---|---|---|---|---|
| 5,173,058 | A | 12/1992 | Broeksteeg et al. | 439/267 |
| 5,785,549 | A * | 7/1998 | Takayasu | 439/495 |
| 6,206,723 | B1 * | 3/2001 | Kunishi | 439/495 |
| 6,383,017 | B1 * | 5/2002 | Takayasu | 439/495 |
| 6,666,711 | B1 * | 12/2003 | Takashita et al. | 439/495 |

FOREIGN PATENT DOCUMENTS

| | | | |
|---|---|---|---|
| JP | 2002134194 | A | 5/2002 |
| JP | 2002329536 | A | 11/2002 |
| JP | 2003045526 | A | 2/2003 |
| JP | 2004039321 | A | 2/2004 |

* cited by examiner

*Primary Examiner*—Tho D. Ta
(74) *Attorney, Agent, or Firm*—Harrington & Smith, LLP

(57) ABSTRACT

An electrical connector with upper contacts, for a flexible flat cable. The connector is an electrical connector for gripping a flexible flat cable by upper contacts, and the connector includes two kinds of contact members for gripping the flexible flat cable, a housing for receiving the contact members, and an opening/closing type actuator. The contacts of the two kinds of the contact members are spaced from each other in an insertion direction, and the contact members are alternately arranged in the housing so as to form staggered rows of the contacts. With a first kind of contact members, FPC can be inserted without insertion force, and with a second kind of contact members, the FPC can be inserted with low insertion force. The connector is characterized in that is has a zero insertion force (Z.I.F.) and low insertion force (L.I.F.) mechanism structure for insertion of the FPC, where the structure is constructed from the first contact members and second contact members.

4 Claims, 3 Drawing Sheets

ELECTRICAL CONNECTOR FOR FLEXIBLE FLAT CABLE

TECHNICAL AREA

The present invention concerns an electrical connector that connects flat flexible cables (FPC (Flexible Printed Cable) and FFC (Flexible Flat Cable) and the like are this type of cable, but herebelow in the present specification, they shall be called FPC).

BACKGROUND ART

Japanese Unexamined Patent Publication No. 2002-190360 discloses a connector wherein, in a FPC connector having a plurality of contacts which grip terminal portions of printed circuit boards, opposed gripping action contacts and fixed pieces are formed separately. In said connector, the gripping action contacts comprise two types of gripping action contacts with differing lengths, and gripping action contacts with differing lengths are placed so that they are adjacent to each other, so that the contact portions of the ends of the gripping action contacts are placed in a staggered manner. Additionally, fixed pieces affixed to the body at locations corresponding to each of the contact points are formed. The space between each of the opposing contact points is smaller than the thickness of a FPC, and when a FPC is inserted, there is a low insertion force (LIF) because of contact with each of the contact points. That is, after insertion, the FPC first comes into contact with a first contact point, and further, when inserted more deeply, it comes into contact with a second contact point, and is gripped by the elastic force of the gripping action contact at each contact point. In the next action, gripping action contacts with different lengths are elastically deformed by an actuator, in order to grip the FPC even more strongly.

However, according to this structure, when the inserted FPC is gripped, a pressing force due to the actuator is further added to the elastic force of the gripping action contacts, so that it becomes easy for warping to arise in the aforementioned FPC, and four parts, being the contact portions and fixed piece portions of the first and second contact points must be manufactured, so that an increase in manufacturing cost is incurred.

Additionally, Japanese Unexamined Patent Publication No. 2002-134194 discloses a connector wherein, in a FPC (flat cable) connector, there are two types of contacts being a first type and a second type separated and placed towards the anterior and posterior of the insertion direction, pressing portions provided for the first contacts, and driving portions (actuator) provided for the second contacts. The pressing portions are supported so that they can be brought closer to or separated from the first contacts provided to the anterior of the insertion direction, and they come into contact with the aforementioned FPC by being brought close to the aforementioned first contacts, and pushing the first contact points onto the first contacts. The driving portions contact the aforementioned FPC by being brought close to the second contacts provided to the posterior of the insertion direction, and by doing so, the second contact points are pressed onto the aforementioned second contacts, and simultaneously, the aforementioned pressing portions are driven and brought close to the first contacts.

A structure is disclosed wherein the contact points of the first and second contacts of the aforementioned connector are provided on the base side whereon the FPC is gripped, and so-called gripping at lower contacts is realized. In order to solve the problems of the conventional art that when a flat cable is inserted, the contacts are damaged, or that imperfect connection states can arise, and in order to solve the problem of the conventional art that since the operation of inserting a flat cable against a low resistance force is required, operability is inferior, in said connector, insertion can be done against the second contacts in the posterior of the insertion direction with no insertion force (Zero Insertion Force: ZIF), and insertion can be done against the first contacts in the anterior of the insertion direction with a low insertion force (Low Insertion Force: LIF).

However, at the present time, there is a demand for electrical connectors with various other shapes which realize industrial applicability, for example structures that are adapted for boards which are compatible with electrical connectors.

DISCLOSURE OF THE INVENTION

The present inventors, as a result of keen investigation, suggest as follows a new structure that grips a FPC by upper contact points, in response to the aforementioned demands.

According to an embodiment of the present invention, the electrical connector of the present invention is an electrical connector which grips a FPC, and said connector is equipped with two types of contacts which grip the aforementioned FPC, a body which houses said contacts, and an opening and closing actuator.

The contact points of the aforementioned two types of contacts are separated by a space in the insertion direction, and they comprise a row of contact points in a staggered form by alternately aligning each said type of contact within the aforementioned body.

In the first type of contact, one end of a first contact beam having a first contact point in contact with a first surface of a FPC, and one end of a fixed base beam supporting a second surface of the aforementioned FPC are joined, and each of the other ends of the first contact beam and fixed base beam which oppose each other are free ends.

Said first contact beam has an actuator-driven portion in the vicinity of the aforementioned free end, and when the actuator is opened, said actuator-driven portion elastically deforms the aforementioned free end of the aforementioned first contact beam, and opens the aforementioned free end in the opposite direction from the aforementioned base beam, and when the actuator is closed, by releasing the elastic deformation of the aforementioned free end of the aforementioned first contact beam, the aforementioned first contact point comes into contact with the aforementioned first surface of the FPC.

The second type of contact is integrally formed through an attaching portion by a second contact beam and a fixed base beam which oppose each other.

Said second contact beam has one free end having an actuator-driven portion in its vicinity, and another free end having a second contact point in contact with the first surface of the aforementioned FPC, and has a structure wherein, due to the fact that when the actuator is closed, the driving portion of the actuator presses upon the aforementioned one free end of the second contact beam, and elastically deforms the aforementioned second contact beam, so that the second contact point of the aforementioned other free end presses on the first surface of the FPC.

In the electrical connector according to the present invention, for example, when the actuator is opened (activated), the first contacts have a structure whereby the first contact beam is pressed and elastically deformed so that the first contact point to the posterior of the insertion direction is released and an FPC can be inserted with no insertion force, and the second contacts have a structure whereby the second contact beam has a second contact point to the anterior of the insertion direction when a FPC is inserted, so a low insertion force is needed for complete insertion. That is, due to the first contacts and the second contacts, a structure with zero insertion force (ZIF) and low insertion force (LIF) during FPC insertion is realized.

Additionally, when the actuator is closed, in the first contacts, the aforementioned one end of the pressed and elastically deformed first contact beam is released from being restrained, and when it tries to return to its original position by its own elastic force, the first contact point on said first contact beam comes into contact with the first surface of the FPC, and a pressing force acts and grips the FPC along with the support portion of the base side, that is, the FPC is gripped by the upper contact point and the lower support portion. The second contacts have a structure wherein, in a state where a FPC is completely inserted with a low insertion force, the second contact beam elastically deforms due to the driving portion of the actuator, and presses upon the first surface of the FPC with the second contact point on said second contact beam.

According to another embodiment of the present invention, the aforementioned second contact beam of the second contact has a high rigidity from the one end that is the actuator-driven portion to the aforementioned attaching portion, and has a low rigidity from said attaching portion to the other end.

For example, by increasing the rigidity by making the length from the one end that is the actuator-driven portion of the aforementioned second contact beam to the aforementioned attaching portion long, selecting a material with high rigidity, or making the thickness of said second contact beam thicker, a high pressing force can be applied on the actuator-driven portion. Further, by lowering the rigidity by selecting a material with low rigidity for the portion from the aforementioned attaching portion to the other end, or making the thickness of the second contact beam thinner, the second contact point that is the aforementioned other end can respond flexibly to the resistance force from the FPC.

According to another embodiment of the present invention, the aforementioned second contact beam of the electrical connector of the present invention is slanted in the direction of the aforementioned fixed base.

In addition to the material and elastic force of the aforementioned second contact beam, by giving it a free slanting angle, the contact pressure between the aforementioned second contact point and the FPC can be freely adjusted.

According to another embodiment of the present invention, the lengths of each of the contact beams of the aforementioned two types of contacts are determined so that there is a constant space between the contact points in the FPC insertion direction.

For the location of the contact point on the aforementioned first contact beam of the aforementioned first type of contact having zero insertion force and the location of the contact point on the aforementioned second contact beam of the second type of contact having low insertion force, by providing a constant space in the contact beam direction, the lengths and locations of the contact points of the contact beams of each of the contacts can be determined freely, for example, providing a contact point for a zero insertion force contact on the FPC insertion side, and a contact point for a low insertion force contact on the opposite side.

EXPLANATION OF REFERENCE NUMERALS

Figure 1:
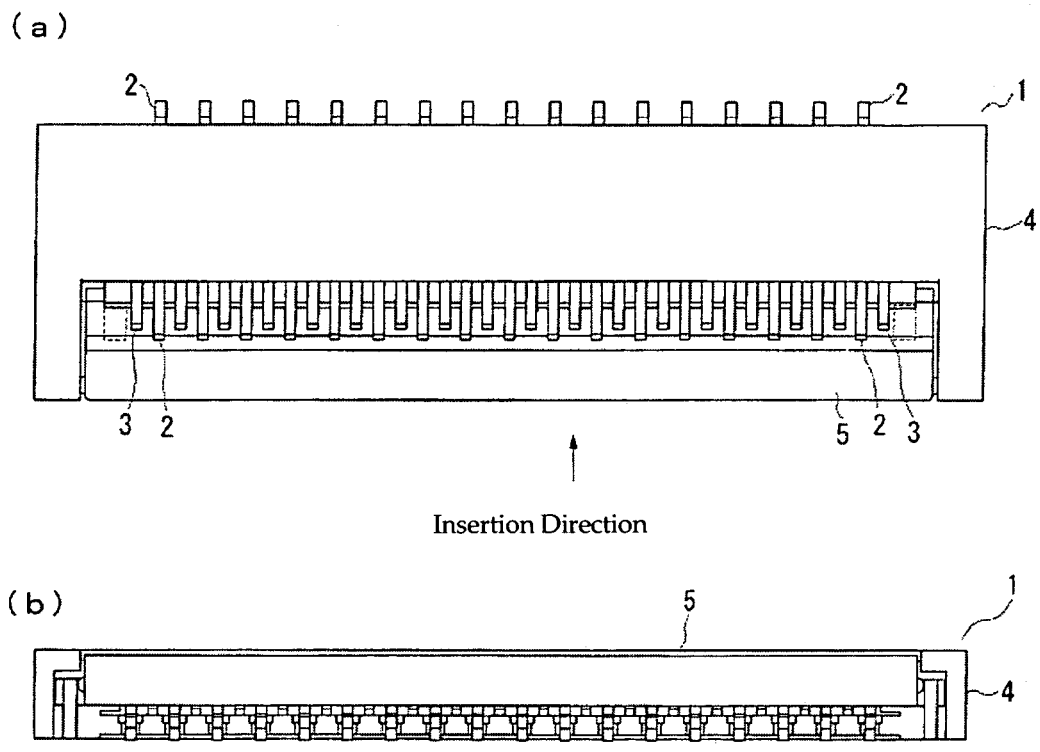
FIG. 1 shows an embodiment of the electrical connector for FPC of the present invention, FIG. 1(*a*) being a top view, and FIG. 1(*b*) being a front view from the insertion surface side.

1 . . . electrical connector for FPC
2 . . . first contact
3 . . . second contact
4 . . . body
5 . . . actuator
6 . . . first contact beam
7 . . . first fixed base beam
8 . . . engaging portion
9 . . . protruding portion of actuator driving portion
10 . . . first contact point
11 . . . second contact beam
12 . . . actuator driving portion
13 . . . second fixed base beam
14 . . . actuator driving portion
15 . . . base side support portion
16 . . . end portion having second contact point
17 . . . base side support portion

BEST MODE FOR EMBODYING THE INVENTION

FIG. 1 shows an embodiment of the electrical connector for FPC according to the present invention. FIG. 1(*a*) is a top view, and FIG. 1(*b*) is a front view from the insertion side. Said connector is equipped with two types of metallic contacts 2 and 3, a body 4, and an actuator 5 that rotates around a protruding portion (not shown) formed in the vicinity of both ends in the longitudinal direction on the insertion direction side of said body. The FPC inserted into said connector, represented by alternating long and short dashed lines in FIGS. 2 through 5, has contact points corresponding to the contact points 10 and 16 of the electrical connector 1, and the contact portions of said FPC and the electrical connector are placed in a staggered manner with a space in between in the cable direction.

Figure 2:
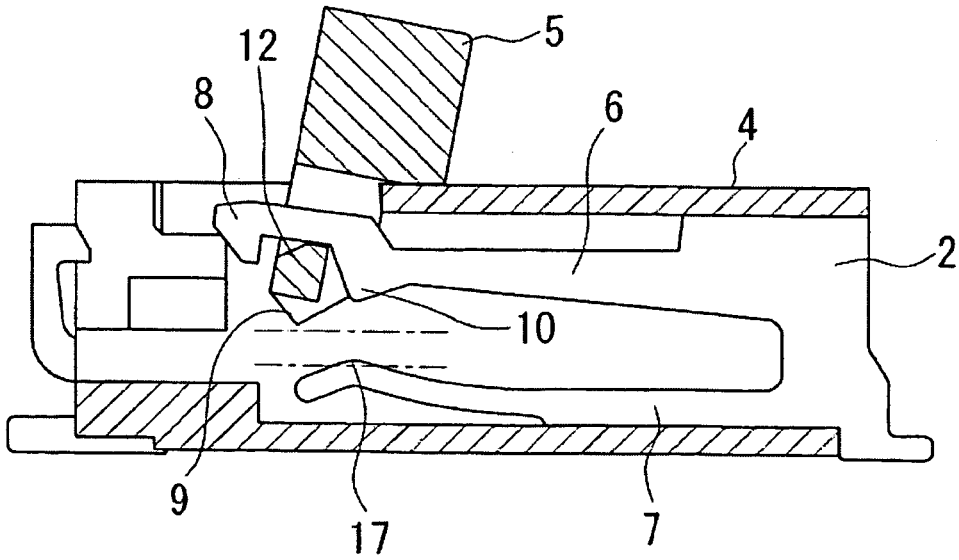
FIG. 2 is a side view of an aforementioned metallic contact 2 provided within the body 4, with the actuator 5 open.

FIG. 2 is a side view of an aforementioned metallic contact 2 provided within the body 4 with the actuator 5 open. Said metallic contact 2 is inserted into the opposite side surface from the FPC insertion surface, and is locked in place in one end of the bottom surface of the body which engages the engaging portion 8 with the driving portion 12 of the actuator and the base portion 7. Further, in said metallic contact 2, each of one of the ends of the opposing base beam 7 and the first contact beam 6 are joined, and each of the other ends of the base beam 7 and the first contact beam 6 are free ends. An engaging portion 8 is formed on the free end portion of said first contact beam, which engages a driving portion 12 of an actuator, and when the actuator is opened, the aforementioned driving portion 12 of an actuator opens the aforementioned free ends being the FPC insertion port, by pushing the engaging portion 8 of the aforementioned first contact beam 6 upwards in a direction perpendicular to the first surface of the FPC, and elastically deforming said first contact beam 6. At that time, the space between the aforementioned open portions is greater than the thickness of the FPC, so that the FPC never comes into contact with the contact point 10 protruding from the first contact beam. Therefore, the metallic contact 2 realizes zero insertion force (ZIF).

Figure 3:
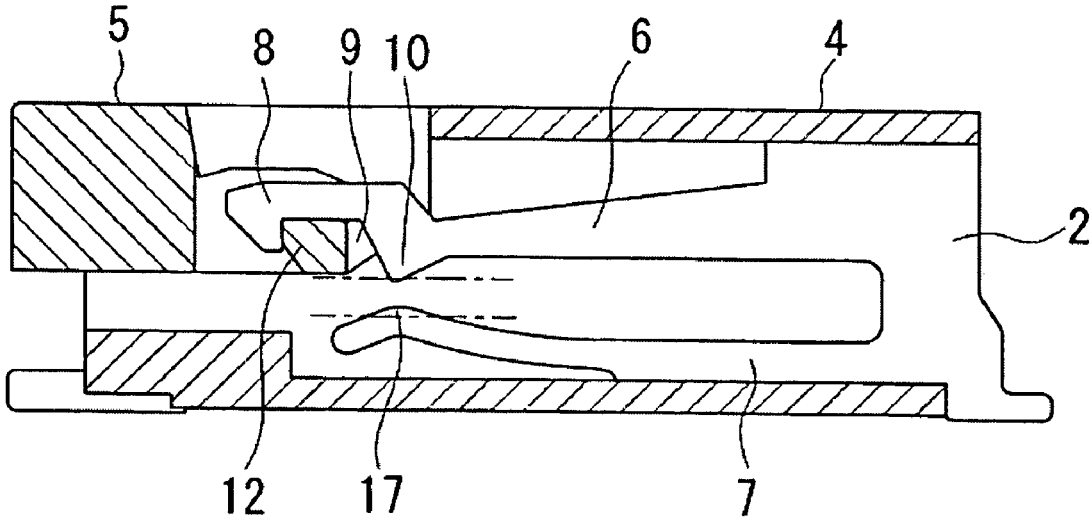
FIG. 3 is a side view of an aforementioned metallic contact 2 provided within the body 4 with the actuator 5 closed.

FIG. 3 is a side view of an aforementioned metallic contact 2 provided within the body 4 with the actuator 5 closed. In the state where the actuator is completely closed, the upper surface of the body is flush. Additionally, since the elastic deformation due to the aforementioned pressing force of the aforementioned driving portion 12 of the actuator is released, the first contact beam 6 returns to its original state under its own elastic force, and since the free end 10 of the first contact beam 6 opposing the base beam which was open, closes, this comes into contact with the FPC and grips it.

Figure 4:
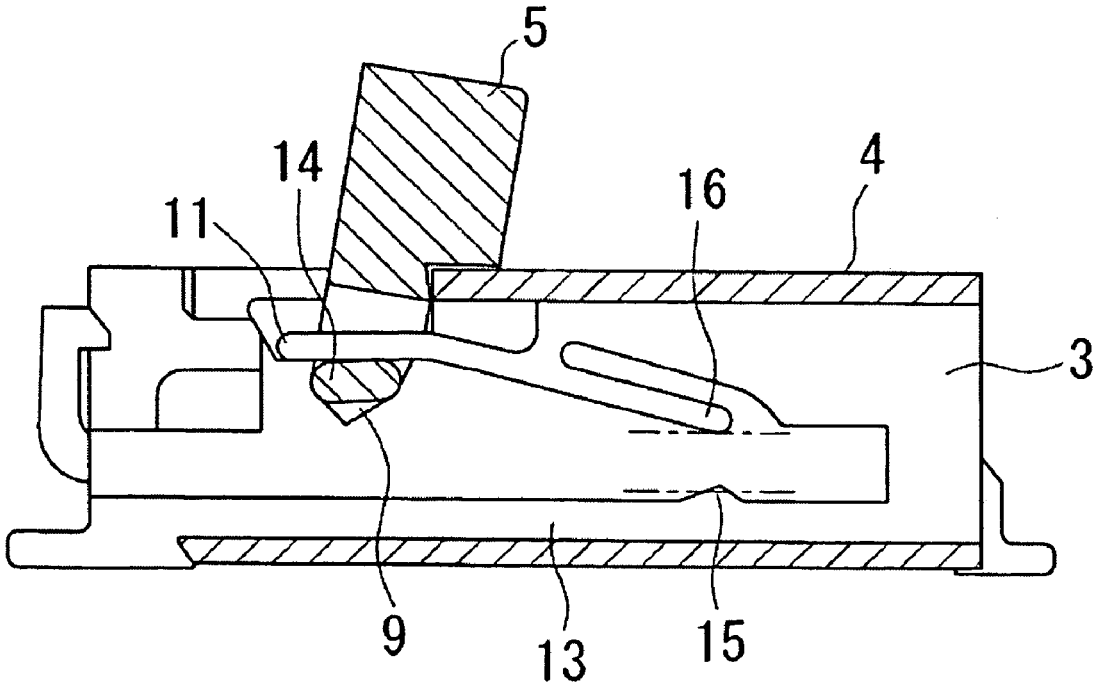
FIG. 4 is a side view of an aforementioned metallic contact 3 provided within the body 4 with the actuator 5 open.

FIG. 4 is a side view of an aforementioned metallic contact 3 provided within the body 4 with the actuator 5 open. Said metallic contact 3 is inserted from the FPC insertion surface, and is locked in place in the insertion surface side end portion of the bottom surface of the body which engages the base portion 13. Further, said metallic contact 3 is integrally formed through a joining portion between the opposing second contact beam 11 and the base beam 13. In said second contact beam, the vicinity of one free end is in contact with the surface in the longitudinal direction of the driving portion 14 of the rectangular actuator, and extends to the other end from said contact portion in the opposing base beam direction at a slanted angle. When an FPC is inserted, the second surface of the FPC is guided along the top of the base beam 13 while the first surface of the FPC is in contact with the aforementioned second contact beam. The FPC is completely inserted as is under low insertion force (LIF).

Figure 5:
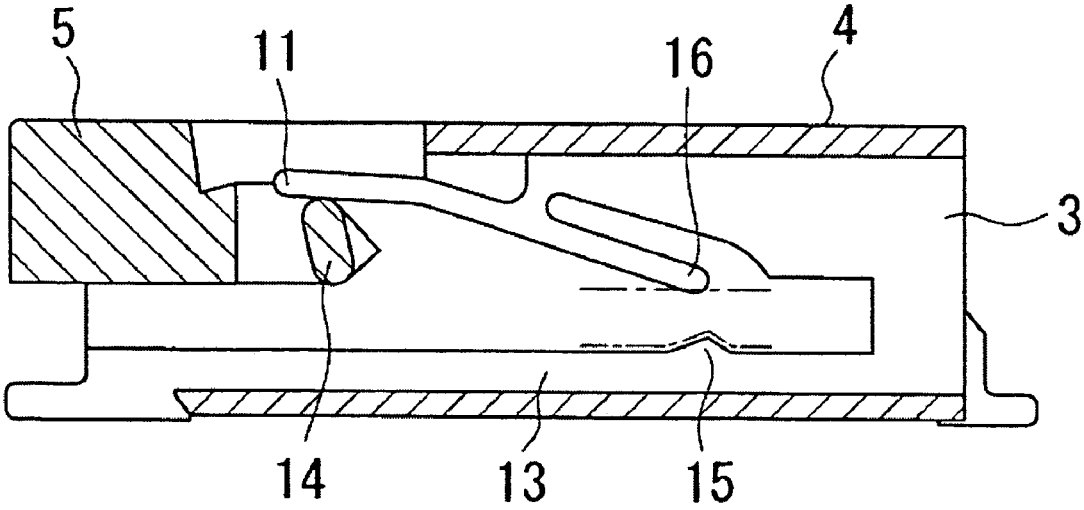
FIG. 5 is a side view of an aforementioned metallic contact 3 provided within the body 4 with the actuator 5 closed.

FIG. 5 is a side view of an aforementioned metallic contact 3 provided within the body 4 when the actuator 5 is closed. The moving portion 14 of the aforementioned actuator rotates along with the closing motion of the aforementioned actuator, and presses upward on the aforementioned second contact beam free end in a direction perpendicular to the first surface of the FPC, elastically deforming said second contact beam, and as a result, the second contact point being the other end of said second contact beam 11 further presses on the first surface of the FPC and grips the FPC.

The structures of two types of contacts have been explained above, but the connector according to the present invention is not restricted to the embodiments described in the specification.

In each attached drawing, the adjacent contacts are omitted and not shown. The alternating long and short dashed lines shown in FIGS. 2–5 show the insertion location of an FPC.

EFFECTS OF THE INVENTION

With an electrical connector having an upper contact point with a structure wherein, when an FPC is inserted, zero insertion force and low insertion force are simultaneously created, and two types of contacts are placed alternately in a staggered manner, a warping preventing effect and an operability improving effect can be expected during FPC insertion and when the FPC is gripped. Said electrical connector can be said to be an invention that has similar functions to electrical connectors with a lower contact point structure, that is responsive to industrial demands and usability.

The invention claimed is:

1. An electrical connector characterized by being an electrical connector for gripping a flat flexible cable, said connector having two types of contacts for gripping the aforementioned flat flexible cable, a body for housing said contacts, and an actuator which opens and closes, having a structure wherein there is a space in the insertion direction between each of the contact points of the aforementioned two types of contacts, and a row of contact points in a staggered form is constituted by aligning said each contact alternately within the aforementioned body, in the contacts of the first type, one end of a first contact beam has a first contact point that comes into contact with a first surface of a flat flexible cable and one end of a fixed base beam supports a second surface of the aforementioned flat flexible cable being connected, and each of the opposing other ends of the first contact beam and the fixed base beam are free ends, said first contact beam has an actuator-driven portion in the vicinity of the aforementioned free end, said actuator-driven portion having a structure such that, when the actuator is open, the aforementioned free end of the aforementioned first contact beam is elastically deformed to open the aforementioned free end in the opposite direction from the aforementioned base beam, and when the actuator is closed, by releasing the elastic deformation of the aforementioned free end of the aforementioned first contact beam, the aforementioned first contact point is put into contact with the first surface of the aforementioned flat flexible cable, the second type of contact is integrally formed by an opposing second contact beam and fixed base beam through a joining portion, said second contact beam has one free end having an actuator-driven portion in the vicinity of said second contact beam, and another free end having a second contact point which comes into contact with the first surface of the aforementioned flat flexible cable, and when the actuator is closed, the driving portion of the actuator presses on the aforementioned one free end of a second contact beam to elastically deform the aforementioned second contact beam, whereby the second contact point of the aforementioned other free end presses on the first surface of the flat flexible cable.

2. An electrical connector recited in claim 1, wherein the second contact beam of the aforementioned second type of contact has a high rigidity from the one end being an actuator-driven portion, to the aforementioned joining portion, and has a low rigidity from the aforementioned joining portion to the other end.

3. An electrical connector recited in claim 1, wherein the aforementioned second contact beam is slanted in the direction of the aforementioned fixed base direction.

4. An electrical connector recited in claim 1, wherein the lengths of each of the contact beams of the aforementioned two types of contacts are determined in such a way that there is a constant space between each contact point in the flat flexible cable insertion direction.

* * * * *